US012571278B2

(12) United States Patent
Angstmann et al.

(10) Patent No.: US 12,571,278 B2
(45) Date of Patent: Mar. 10, 2026

(54) WELL CONTROL SEALING SYSTEM

(71) Applicant: Kinetic Pressure Control Ltd., Houston, TX (US)

(72) Inventors: Steven Angstmann, Houston, TX (US); Bobby Gallagher, Houston, TX (US); Billy Gallagher, Houston, TX (US); Sean Laird, Houston, TX (US)

(73) Assignee: Kinetic Pressure Control Ltd., Houston, TX (US)

( * ) Notice: Subject to any disclaimer, the term of this patent is extended or adjusted under 35 U.S.C. 154(b) by 50 days.

(21) Appl. No.: 18/582,532

(22) Filed: Feb. 20, 2024

(65) Prior Publication Data

US 2024/0247561 A1 Jul. 25, 2024

Related U.S. Application Data

(63) Continuation-in-part of application No. 17/789,207, filed as application No. PCT/US2021/012325 on Jan. 6, 2021, now Pat. No. 12,264,548.

(60) Provisional application No. 62/957,891, filed on Jan. 7, 2020.

(51) Int. Cl.
*E21B 33/06* (2006.01)

(52) U.S. Cl.
CPC ..... *E21B 33/06* (2013.01)

(58) Field of Classification Search
CPC ..... E21B 33/062; E21B 33/063
USPC ..... 251/1.1, 1.3, 358
See application file for complete search history.

(56) References Cited

U.S. PATENT DOCUMENTS 2,593,793 A * 4/1952 Rector ..... E21B 33/062 251/1.3
3,078,865 A * 2/1963 Estes ..... F16K 3/36 137/246.22
3,766,979 A * 10/1973 Petrick ..... E21B 29/08 166/63

* cited by examiner

*Primary Examiner* — Daphne M Barry
(74) *Attorney, Agent, or Firm* — Victor H. Segura

(57) ABSTRACT

A blowout preventer includes a main body having a through bore and defining a passage transverse to the through bore. At least one seal is configured for positioning with an opening on the seal coincident with the through bore. The at least one seal being disposed to engage an element disposed in the transverse passage. The at least one seal being configured to receive a fluid under pressure to energize the seal to restrict fluid flow between the through bore and the transverse passage when the element is disposed proximate the through bore. A method for operating a blowout preventer.

22 Claims, 13 Drawing Sheets

WELL CONTROL SEALING SYSTEM

CROSS REFERENCE TO RELATED APPLICATIONS

This is a Continuation-in-Part application of U.S. application Ser. No. 17/789,207 filed on Jun. 26, 2022, which is a Continuation of International Application No. PCT/US2021/012325 filed on Jan. 6, 2021, which claims priority from U.S. Provisional Application No. 62/957,891 filed on Jan. 7, 2020. All foregoing applications are incorporated herein by reference in their entirety.

BACKGROUND

The present disclosure relates generally to sealing mechanisms. More specifically, the present disclosure relates to sealing systems for implementation with well control systems.

Blowout preventers (BOPs) for oil and gas wells are used to prevent potentially catastrophic events known as blowouts, where high well pressures and uncontrolled flow from a subsurface formation into the well can expel tubing (e.g., drill pipe and well casing), tools and drilling fluid out of a well. Blowouts present a serious safety hazard to drilling crews, the drilling rig, and the environment and can be extremely costly. Typically, BOPs have "rams" that are opened and closed by actuators. The most common type of actuator is operated hydraulically to push closure elements across a through bore in a BOP housing to close the well. In some cases, the rams have shears to cut through a drill string or other tool which may be in the well at the time it is necessary to close the BOP.

Pyrotechnic gas pressure operated BOP rams have also been proposed. An example of such a pyrotechnic gas pressure operated BOP ram is described in U.S. Pat. No. 10,465,466 issued to Kinetic Pressure Control Limited. A pyrotechnic gas pressure is used to urge a gate to accelerate in a bore, whereby kinetic energy of the gate may be used to shear any devices disposed in a BOP housing through bore, thus closing the BOP. Such rams are referred to as "kinetic" BOP rams. In such kinetic BOP rams, a gate traverses through the BOP housing to shear an object within the through bore and close off the well bore. A need remains for improved means to provide adequate sealing to prevent undesired fluid migration between the housing passage and the through bore to maintain system integrity.

SUMMARY

According to an aspect of the invention, a blowout preventer includes a main body having a through bore, the main body defining a passage transverse to the through bore. A first seal is configured for positioning with an opening on the first seal coincident with the through bore. A second seal is configured for positioning with an opening on the second seal coincident with the through bore. The first and second seals are disposed across from one another and configured to accept an element therebetween. The first and second seals are each configured to receive a fluid under pressure to energize the seal to restrict fluid flow between the through bore and the passage when the element is disposed between the seals.

According to another aspect of the invention, a blowout preventer includes a main body having a through bore, the main body defining a passage transverse to the through bore. A first seal is disposed on an insert configured for disposal within the main body with an opening on the first seal coincident with the through bore. A second seal is disposed on the insert configured for disposal within the main body with an opening on the second seal coincident with the through bore. The first and second seals are disposed on the insert across from one another and configured to accept an element therebetween. The first and second seals are each configured to receive a fluid under pressure to energize the seal to restrict fluid flow between the through bore and the passage when the element is disposed between the seals.

According to another aspect of the invention, a method for operating a blowout preventer (BOP) includes a BOP having a main body with a through bore and a passage transverse to the through bore, a first seal configured for positioning with an opening on the seal coincident with the through bore, a second seal configured for positioning with an opening on the seal coincident with the through bore, the first and second seals disposed across from one another and configured to accept an element therebetween. The method includes applying fluid under pressure to the first and second seals to energize the seals to restrict fluid flow between the through bore and the passage when the element is disposed between the seals.

According to another aspect of the invention, a method for operating a blowout preventer (BOP) includes a BOP comprising a main body having a through bore and a passage transverse to the through bore, a first seal configured for positioning with an opening on the first seal coincident with the through bore, a second seal configured for positioning with an opening on the second seal coincident with the through bore, the first and second seals disposed across from one another and configured to accept an element therebetween. The method includes energizing the first and second seals to restrict fluid flow between the through bore and the passage when the element is disposed between the seals by: applying a first fluid under pressure to the first and second seals; and applying a second fluid under pressure to the first and second seals to energize the seals.

BRIEF DESCRIPTION OF THE DRAWINGS

The following figures are included to further demonstrate certain aspects of the present disclosure and should not be used to limit or define the claimed subject matter. It should be understood that the embodiments are not limited to the precise arrangements and configurations shown in the figures, in which like reference numerals may identify like elements. The figures are not necessarily drawn to scale, and certain features may be shown exaggerated in scale or in generalized or schematic form, in the interest of clarity and conciseness.

DETAILED DESCRIPTION

Figure 1A:
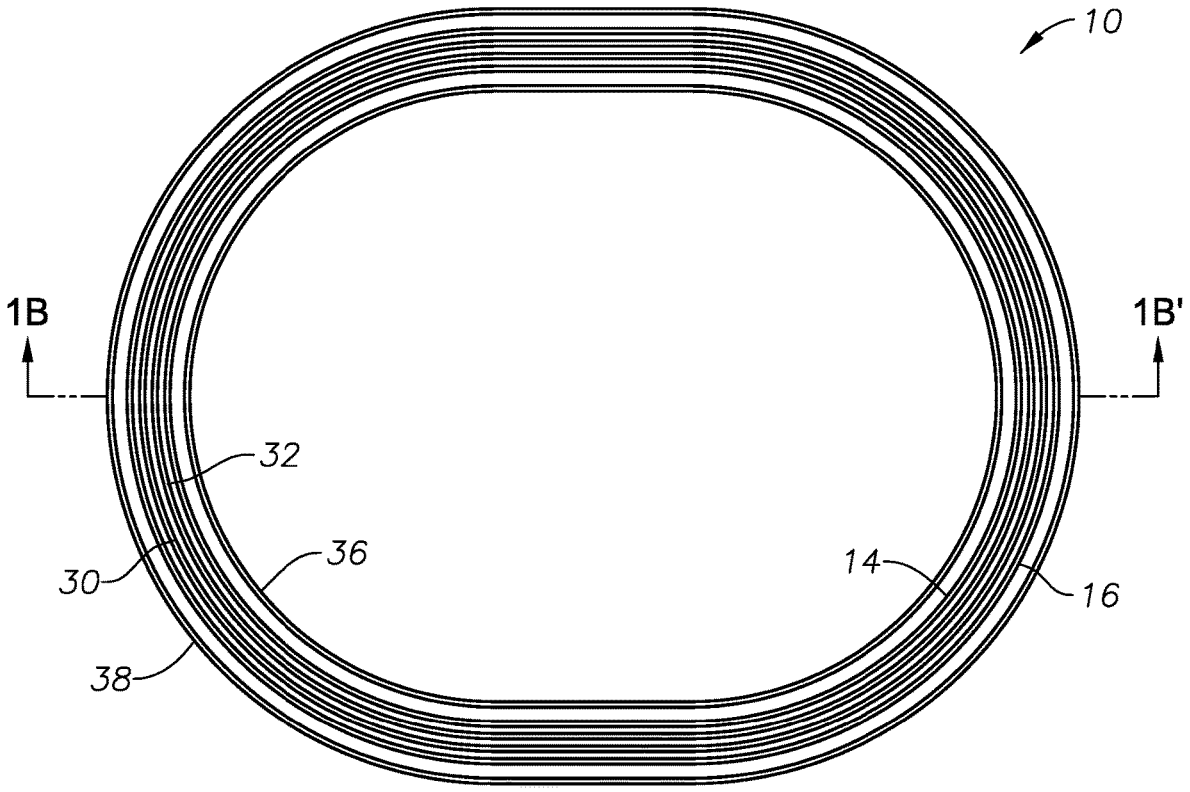
FIG. 1A shows a plan view of an example embodiment of a seal according to this disclosure.

FIG. 1A shows a plan view of an example embodiment of a seal 10 according to this disclosure. The seal 10 may be shaped as an annular ring. The embodiment in FIG. 1A may have an oval or "racetrack" configuration. Embodiments of the seal 10 can be implemented with various dimensions along either or both the major axis and the minor axis, and some embodiments may also be implemented in circular configurations. It will be appreciated by those skilled in the art that a seal 10 according to this disclosure may be formed from conventional materials suitable for the desired application as known in the art (e.g., resilient materials, elastomers, rubber compounds, synthetic elastomeric materials, composites, etc.).

Figure 1B:
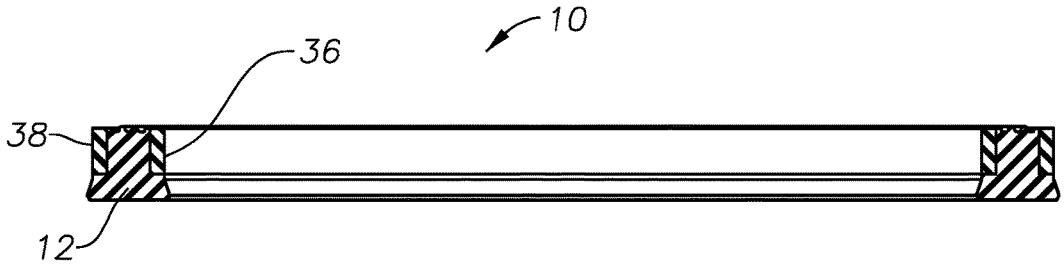
FIG. 1B shows a cross-section of the seal along section line 1B-1B' in FIG. 1A.

FIG. 1B shows a cross-section of the example embodiment of the seal 10 along section line 1B-1B' in FIG. 1A. The seal 10 includes a centrally disposed body 12, which can vary in height (thickness) depending on the desired application for the seal 10.

Figure 1C:
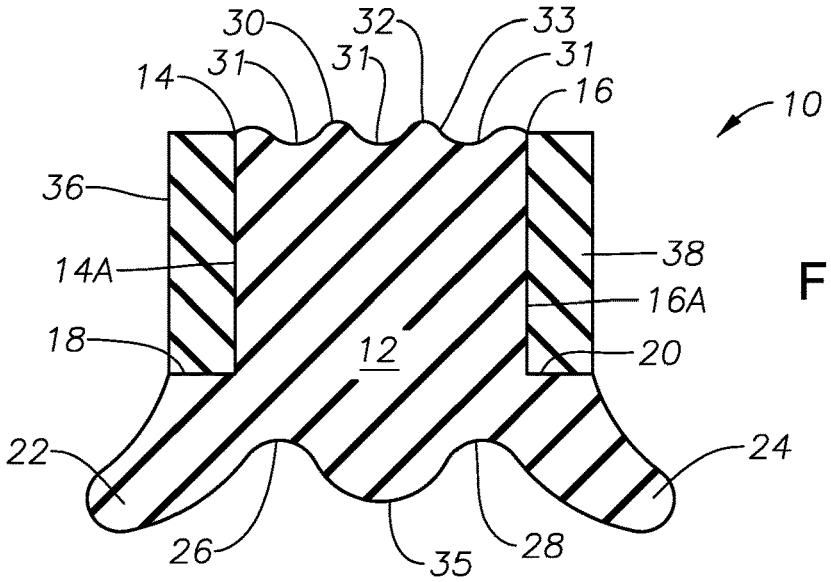
FIG. 1C shows an enlarged view of a cross-section of the seal 10 indicated in detail B of FIG. 1B.

FIG. 1C shows an enlarged view of a cross-section of the example embodiment of the seal 10 as indicated in detail B of FIG. 1B. One side of the seal 10 forms an inner diameter wall 14 and the opposite side forms an exterior diameter wall 16. The positions of the respective walls 14, 16 with reference to the seal 10 are shown in FIG. 1A. Each wall 14, 16 extends from the top surface 33 of the seal 10 toward the bottom surface 35 of the seal 10, forming a smooth annular surface. The lower section of each wall 14, 16 may extend outward, respectively, forming an inner ledge or shoulder 18 and an outer ledge or shoulder 20. Below the inner shoulder 18; the lower body portion of the seal 10 defines a sloping surface extending outward (laterally) from the body 12 of the seal 10 to form an inner wing 22. Similarly, the lower body portion of the seal 10 extending from the outer shoulder 20 defines a sloping surface extending outward (laterally) from the body 12 of the seal 10 to form an outer wing 24. The bottom surface 35 of the seal 10 may comprise a pair of concentric (with reference to the entire seal 10) recesses or grooves 26, 28 extending along the entire loop of the seal, shown in FIG. 1C as an indentation or recess adjacent to each wing 22, 24. The recesses or grooves 26, 28 enable each wing 22, 24 to have flexibility to spread outward or compress inward (laterally) depending on the forces applied to the seal 10 (such forces further described below). A tip of each wing 22, 24 may be shaped to provide effective sealing with minimal surface contact area of each wing with respect to a surface to which the wings are intended to seal, as further explained herein.

In some embodiments, the seal 10 includes one or more raised portions 30, 32 extending from an upper seal surface 33. Each raised portion 30, 32 may be formed as a ring extending along the entire loop of the upper seal surface 33. Example positions of the raised portions 30, 32 with reference to the entire seal 10 are shown in FIG. 1A. In some embodiments, the upper seal surface 33 may also be configured with corresponding recessed portions 31 formed as grooves, recesses or trenches running along the entire loop of the upper seal surface 33. When the seal 10 is installed in an application wherein the raised portions 30, 32 contact another surface in a compressive sealing engagement (e.g., see FIG. 3), the recessed portions 31 provide space for the material of the raised portions 30, 32 to be compressed and displaced.

An inner element 36, e.g., a structural reinforcement, may disposed in a relief 14A formed on the inner circumference of the seal 10. The inner element 36 is configured to abut against the surface of the inner wall 14, its upper end being flush with the top edge of the seal 10 wall and disposed on the inner shoulder 18 at its lower end. An outer element 38, e.g., a structural reinforcement, may fitted over the seal 10 in a relief 16A formed on the outer circumference, its upper end being flush with the upper surface 33 and disposed on the outer shoulder 20 at its lower end. In some embodiments, the upper end of the inner 36 and/or outer 38 elements may be slightly recessed from the upper surface 33. "Upper" and "lower" as used in this description mean only the orientation with reference to the drawing figures and are not intended to limit the physical orientation of the seal 10 in any application for the seal 10. The inner and outer elements 36, 38 may each comprise a solid annular ring or a spring (e.g., shaped as a toroid) respectively sized to conform to the ID and OD of the body 12 (see FIG. 1A). The elements 36, 38 may be formed from conventional materials suitable for the desired application as known in the art. In some embodiments, the inner and/or outer elements 36, 38 may be formed from harder or more rigid materials (e.g., metal, hard thermoplastic, etc.) than the material used to form the seal body 12. The inner and outer elements 36, 38 may be affixed to the seal body 12 by any suitable means as known in the art (e.g., heat fusing, adhesives, interference fit, etc.). In some embodiments, the elements 36, 38 may be molded into the seal body 12 using manufacturing techniques as known in the art.

Figure 2:
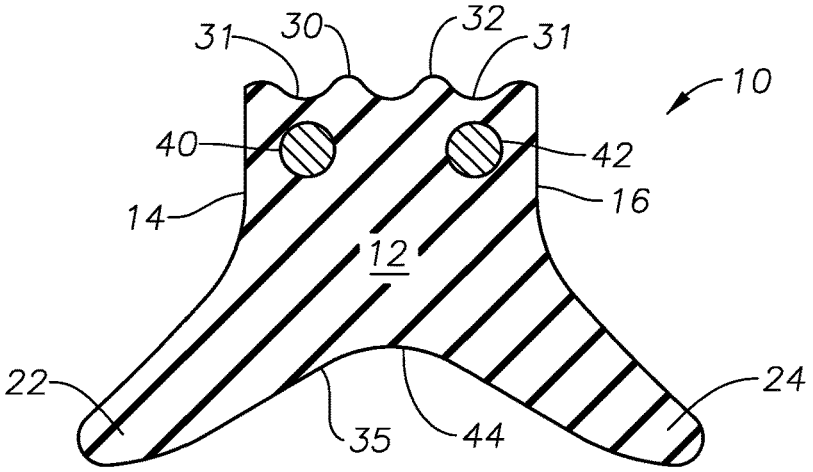
FIG. 2 shows a cross-section of another embodiment of a seal according to this disclosure.

FIG. 2 shows a cross-section of another embodiment of a seal 10 according this disclosure. The seal 10 may comprise a pair of rings 40, 42 embedded within the seal body 12. The rings 40, 42 are disposed near the upper surface of the seal 10, with one ring 40 placed close to the inner wall 14 and the other ring 42 placed close the outer wall 16. The rings 40, 42 may be formed from a less resilient material than the seal body 12, such as metal or hard plastic, and may be formed as a one-piece or multi-piece loop extending along the entire loop of the seal 10. In some embodiments, the rings 40, 42 comprise metallic springs, e.g., made from spring metal such as phosphor bronze. The rings 40, 42 may be molded within the seal 10 during fabrication of the seal 10 in any manner known in the art. The rings 40, 42 may provide additional structural support to the seal 10 and may provide resistance to seal extrusion in certain implementations (further described below). The bottom surface 35 of the seal 10 may be configured with a single groove 44 running along the entire loop of the seal, depicted as an indentation or recess disposed symmetrically between the wings 22, 24. Other seal 10 embodiments may be configured with more than one recess or groove 44, as shown in the embodiment of FIG. 1C.

Figure 3:
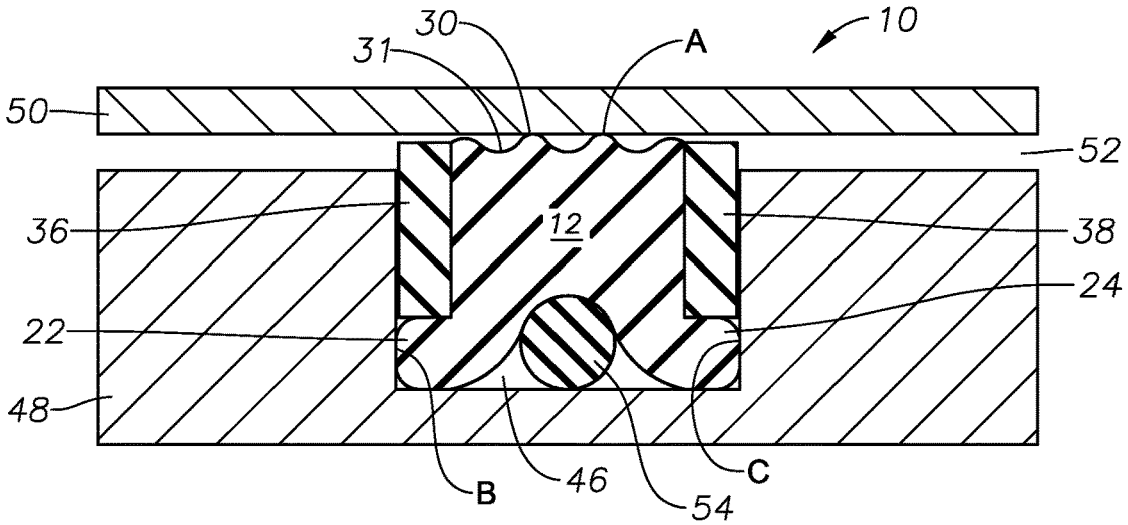
FIG. 3 shows a cross-section of another seal embodiment according to this disclosure.

FIG. 3 shows a cross-section of another example embodiment of a seal 10 according to this disclosure installed within a seal groove or channel 46 formed in a first component 48. The seal 10 is shown compressed between the first component 48 and a second component 50. The first 48 and second 50 components represent an article of manufacture with the components 48, 50 disposed close to one another yet providing a passage, orifice, or separation 52 otherwise allowing fluid (e.g., liquid and/or gas) flow in either direction absent the presence of the seal 10 as shown. It will be appreciated that such a configuration to seal such a passage is well known in articles of manufacture. As installed, the seal 10 is compressed within the channel 46 such that the upper surface of the seal 10 contacts the second component 50. The one or more raised portions 30 on the seal 10 are compressed against the second component 50 surface, forming a sealing face engagement. In some embodiments, an O-ring 54 may be disposed at the bottom of the seal 10, residing between the wings 22, 24. The O-ring 54 aids spreading the wings 22, 24 outwards from the seal body 12, forming a radial sealing engagement B, C against the side walls of the channel 46. As shown in FIG. 3, the seal 10 provides face A and radial B, C sealing against fluid passage along the separation 52. Although shown in a cross-sectional view in FIG. 3, it will be appreciated that the seal 10 is formed as an annular ring or loop in its entirety, similar to the embodiment shown in FIG. 1A.

The present embodiment of the seal 10 may also be configured with inner 36 and outer 38 elements as shown in FIG. 1C. In addition to providing structural support, the inner 36 and outer 38 elements may reduce or prevent wear on the seal 10 edges and resist extrusion of the seal 10 from the channel 46 in applications where the first 48 and/or second 50 component is configured for movement in relation to the other component (e.g., when the installation is such that the second component 50 is configured for sliding motion (left to right in FIG. 3) over the first component 48). Although the seal 10 in FIG. 3 is shown as energized, the seals may also be implemented in configurations where the seal is initially unenergized.

Figure 4A:
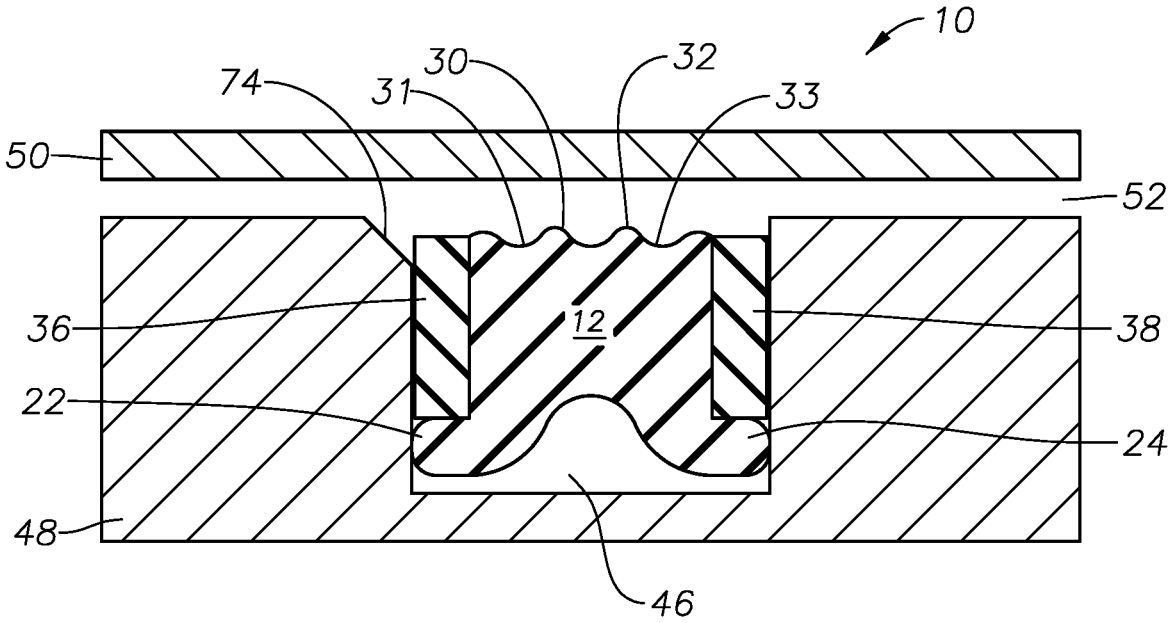
FIG. 4A shows a cross-section of another embodiment according to this disclosure.

FIG. 4A shows a cross-section of another embodiment according to this disclosure. A seal 10 is installed to sit within a channel 46 without providing sealing engagement at its upper surface 33. In such applications, the seal 10 provides lateral sealing against both sides of the channel 46 through the wings 22, 24, without the face A (see FIG. 4B) being in contact with the second component 50. The first component 48 is configured wherein the channel 46 has a deviated edge 74. Embodiments may be implemented with the deviated edge 74 comprising: a taper descending into the channel 46; one or more slots running along the surface of the edge; or porting formed at the edge. The deviated edge 74 can be formed on either or both sides of the channel 46. In the unenergized state, fluid pressure on the space beneath the seal 10 is equal to the fluid pressure in the separation 52 between the first 48 and second 50 components. In this implementation, a structure (e.g., 100 in FIG. 5) comprising first 48 and second 50 components (e.g., 118A, 118B in FIG. 5) may be designed such that fluid pressure in the separation or passage 52 undergoes a significant and rapid increase under certain conditions. Such conditions may comprise, for example, ignition of a charge (e.g., 114 in FIG. 7) generating a gas expanding into the separation or passage 52.

Figure 4B:
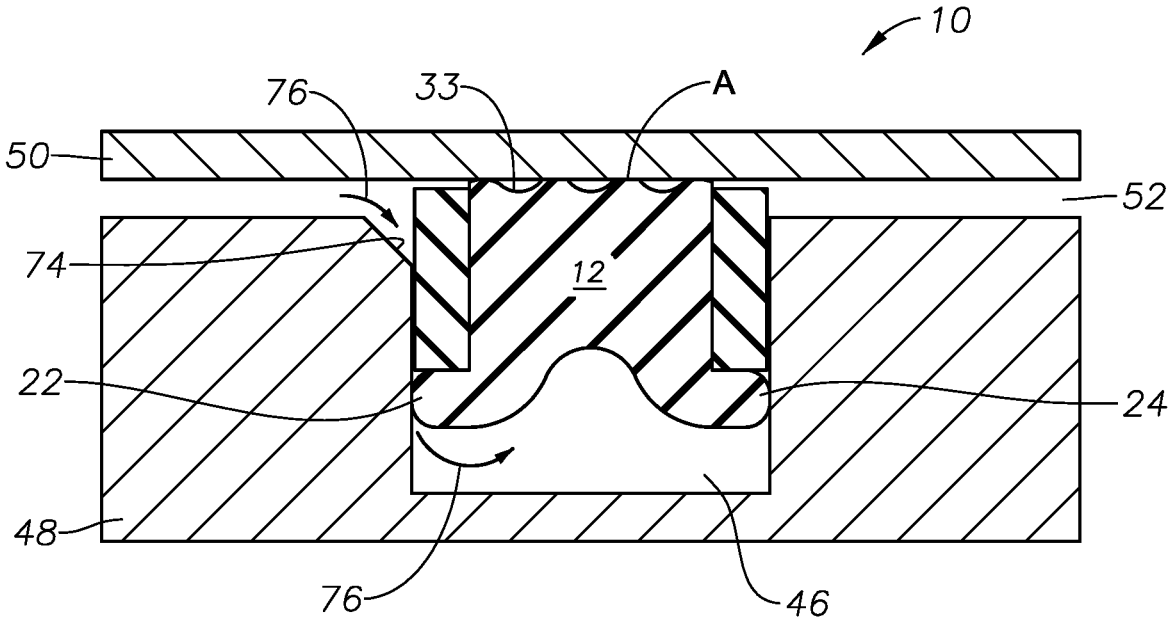
FIG. 4B shows a high-pressure gas traversing a deviated edge and moving into a channel.

FIG. 4B shows such a high-pressure gas (arrow 76) traversing the deviated edge 74 and moving into the channel 46. The flexible wing 22 on the seal 10 permits the high-pressure gas 76 to fill space in the channel 46 beneath the seal 10. The rapid increase in gas pressure acting on the space beneath the seal 10 urges the seal 10 upward in the channel 46 to engage the seal face A against the second component 50, thereby blocking passage of the gas 76 to the other side of the seal 10. After a seal is established by energizing the seal 10, the gas pressure in the channel 46 beneath the seal urges the seal into contact with the second component 50, thereby maintaining a fluid tight seal between the first component 48 and the second component 50. Any of the disclosed seal 10 embodiments may be used as shown in FIGS. 4A and 4B for such activation by application of pressure in the passage 52.

Figure 5:
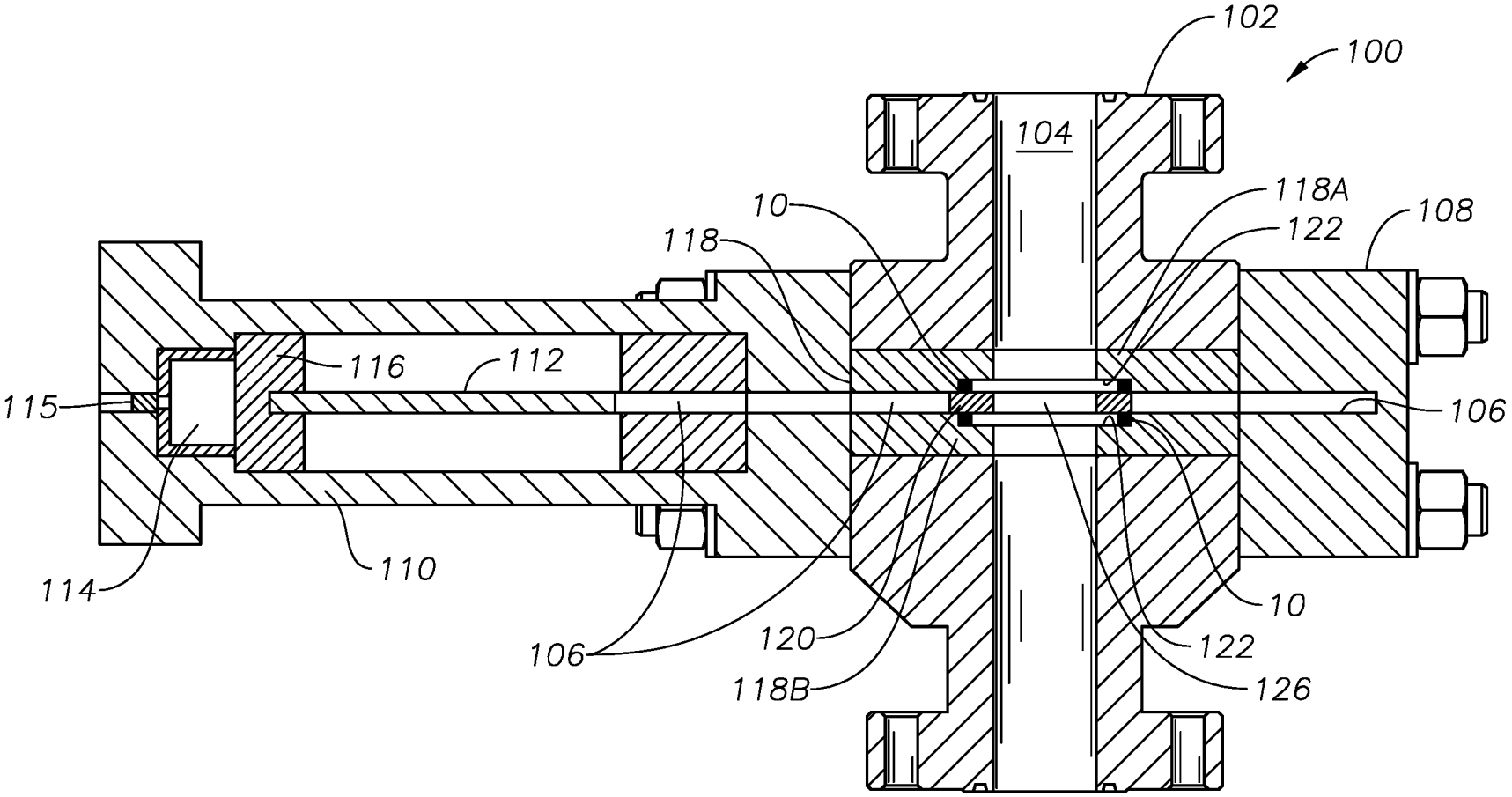
FIG. 5 shows a sectioned elevational view of an example embodiment of a pyrotechnic gas pressure operated blowout preventer (BOP).

Turning to FIG. 5, there is shown a sectioned elevational view of an example embodiment of a pyrotechnic gas pressure operated blowout preventer (BOP) 100, referred to as a "kinetic" BOP. The general structure of the kinetic BOP 100 may be made from steel or similar high strength material. The kinetic BOP 100 comprises a main body 102 having a through bore 104. The main body 102 may be coupled to a wellhead, to another BOP (kinetic or other type) or to a similar structure (not shown), so that flow along the through bore 104 may be closed off by operating the kinetic BOP 100. A passageway 106 that is oriented transversely to the through bore 104 is formed in a cover 108 coupled to one side of the main body 102. The passageway 106 extends though the main body 102 and into a housing defining a pressure chamber 110 adjacent to an opposed side of the main body. The embodiment shown in FIG. 5 is formed with a main body 102 joined to a separate cover 108 and pressure chamber 110, however, such structure is not a limit on the scope of the disclosure. The main body 102 may be shaped to define a pressure chamber and/or a cover in a unitary structure. The passageway 106 provides a travel path for a gate 112. The travel path (passageway 106) enables the gate 112 to attain sufficient velocity resulting from actuation of a pyrotechnic charge 114 and subsequent gas expansion against a piston 116 such that kinetic energy in the gate 112 may be sufficient to sever any device disposed in the through bore 104 and to enable the gate 112 to extend into the passageway 106 across the through bore 104. The pyrotechnic charge 114 is actuated by an initiator 115. Additional description of the operation of a kinetic BOP 100 may be found in U.S. Pat. No. 10,465,466 issued to Angstmann et al. and assigned to the present assignee.

Figure 6:
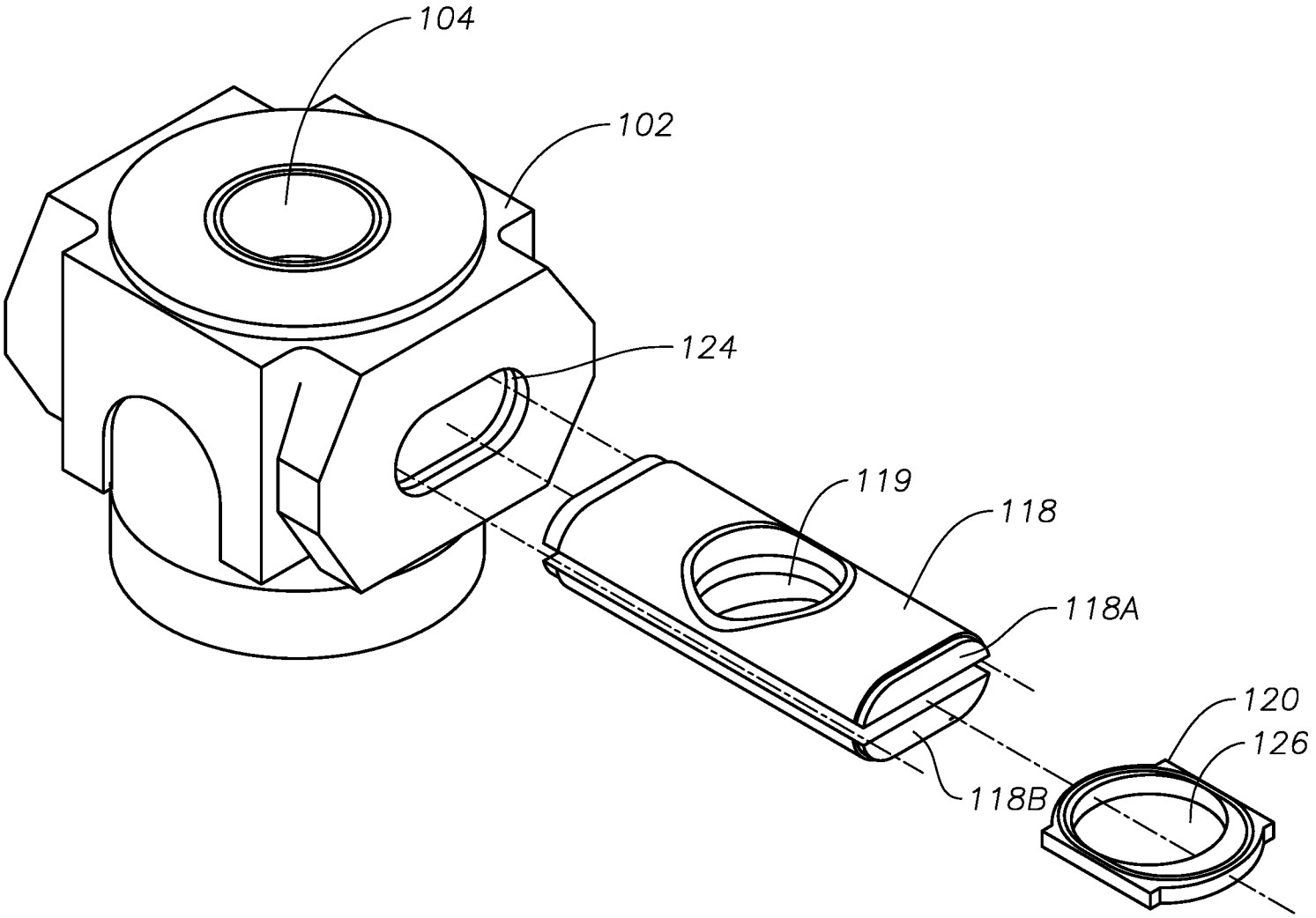
FIG. 6 shows a schematic of an embodiment of a main body of a kinetic BOP.
Figure 7:
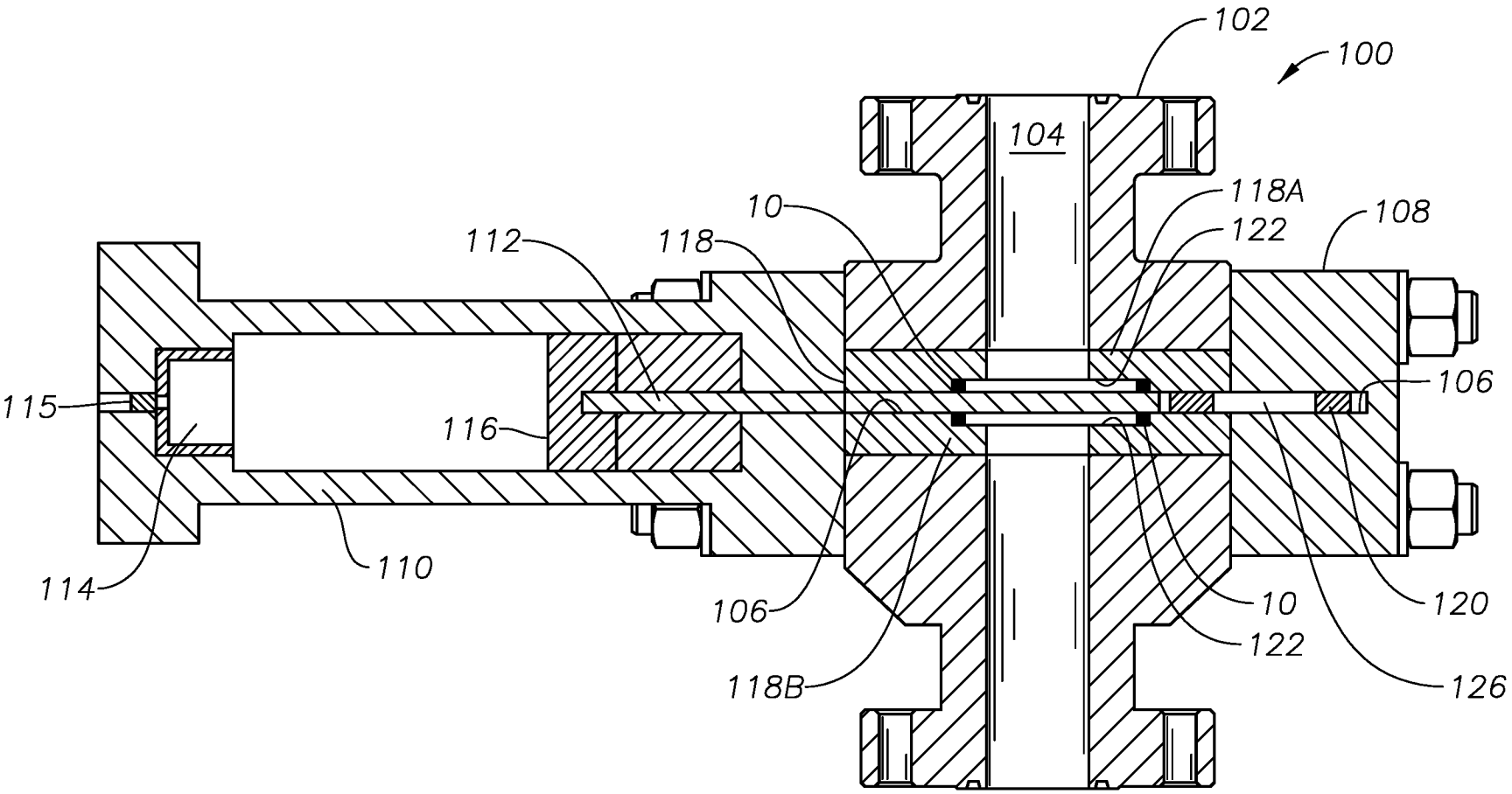
FIG. 7 shows a cross-section view of the BOP of FIG. 5 where a sufficient expansion of hot gases has occurred after activation of a pyrotechnic charge.

An insert 118 may be disposed in the main body 102 to provide effective closure between the through bore 104 and the passageway 106 (see FIGS. 5-7). Such closure provides that fluid pressure in the through bore 104 is excluded from the passageway 106. A ring cutter 120 may be positioned in the passageway 106 within the main body 102. The ring cutter 120 comprises a central opening 126 (also in FIG. 6), which is shown in alignment with the through bore 104 in FIG. 5. The ring cutter 120 severs any device in the through bore 104 when the ring cutter 120 is moved into the through bore 104 by the gate 112 after actuation of the pyrotechnic charge 114. When the gate 112 is disposed across the through bore 104 after actuation of the charge 114, the through bore 104 is thereby effectively closed to flow by the gate 112 being disposed inside the insert 118 thus displacing the ring cutter 120.

The insert 118 comprises a pair of seals 10 according to the present disclosure. One first or upper seal 10 is mounted in a channel 122 formed on a first insert segment 118A. The other second or lower seal 10 is mounted in a channel 122 formed on a second insert segment 118B (see FIG. 6). The seals 10 are disposed on the insert segments 118A, 118B such that the top surface of each seal (e.g., 33 in FIG. 1C) faces the passageway 106 (i.e., transverse to the through bore 104). Each seal 10 is disposed in the respective channel 122 in an unenergized state, i.e., the respective wings (22, 24 in FIG. 4A) in the seals are in contact with the corresponding channel 122 walls to provide lateral sealing, but the top surface seal faces are not in contact with any surface, similar to the configuration shown in FIG. 4A (component 48 in FIG. 4A representing the corresponding insert segment 118A, 118B). The seals 10 may be positioned on the insert 118 such that the central opening (see FIG. 1A) of each seal 10 is concentric with the through bore 104.

FIG. 6 shows a schematic of an embodiment of a main body 102 of a kinetic BOP 100 (similar to the main body 102 of FIG. 5) with an expanded view of an insert 118 embodiment according to this disclosure. In FIG. 6, the main body 102 is shown without a cover 108 or pressure chamber 110 (see FIG. 5) for clarity of illustration. The insert 118 may be configured as a modular assembly having a first insert segment 118A and a second insert segment 118B. The first 118A and second 118B insert segments may be formed from any suitable material, e.g., steel or other high strength metal, and can vary in size and dimensions depending on the dimensions and the pressure rating of the main body 102 used for the desired BOP application. Each insert segment 118A, 118B has an opening 119 formed proximate its central region, passing all the way through the respective insert segment body, thus defining an opening through the insert 118. The main body 102 has a central bore 124 transversely formed therein (with reference to the through bore 104) to receive the insert 118. When disposed in the main body 102, the first 118A and second 118B insert segments are positioned such that their respective openings 119 are substantially aligned with the through bore 104 in the main body 102 (as shown in FIG. 5). The ring cutter 120 may be configured in a generally rectangular shape with flat, planar surfaces. An opening 126 is formed in the central region of the ring cutter 120, passing from the top surface through to the bottom surface of the ring cutter 120. Referring back to FIG. 5, when the first 118A and second 118B insert segments are positioned within the main body 102, the two insert segments 118A, 118B define the passageway 106.

FIG. 7 shows a cross-section view of the BOP 100 of FIG. 5 where a sufficient expansion of hot gases has occurred after activation of the pyrotechnic charge 114 to displace the piston 116 and consequently the gate 112. At this stage, the piston 116 and gate 112 have accelerated through the passageway 106 and the ring cutter 120 has sheared through anything that may have been in the through bore 104. Expanding gases behind the piston 116 propelled the gate 112 and ring cutter 120 past the through bore 104. In the process, some of the high-pressure gas flowed along the passageway 106 (76 in FIG. 4B) to energize the seals 10 in the manner depicted and described with respect to FIG. 4B. Once the piston 116 and gate 112 have traversed the passageway 106 and come to a stop, the gate 112 remains in position within the through bore 104. With the seals 10 energized, the seals 10 provide lateral sealing in the respective channels 122 via the wings 22, 24 and the upper surface 33 seal faces seal against the gate 112 surfaces to stop any flow of fluids from the through bore 104 and into the passage 106, thereby closing the through bore 104 to fluid flow.

Figure 8:
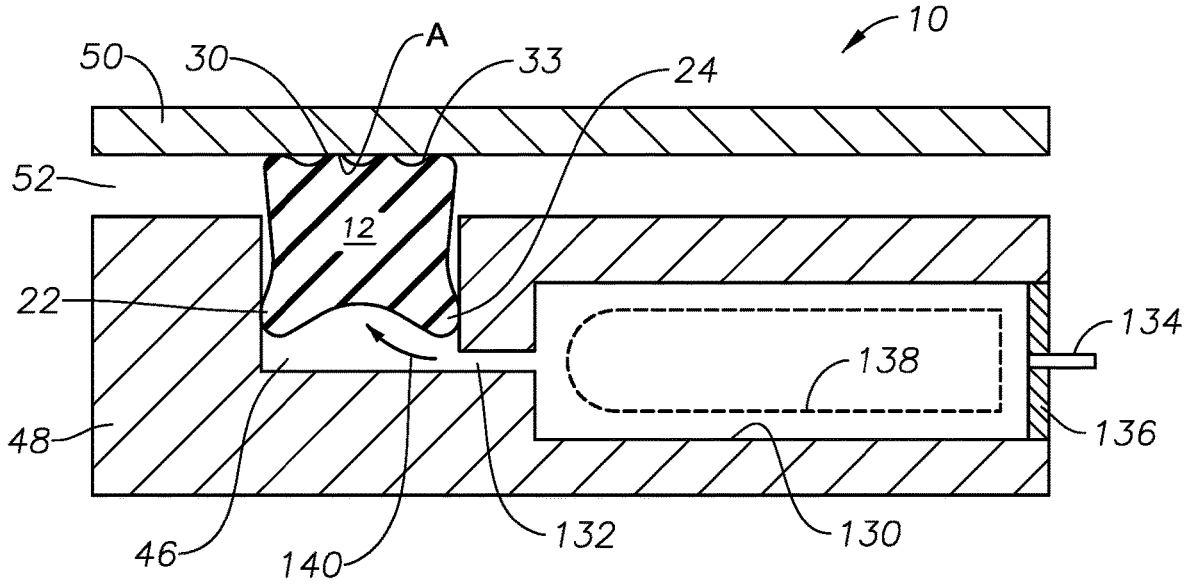
FIG. 8 shows a cross-section of another embodiment of a seal according to this disclosure.

FIG. 8 shows a cross-section of another embodiment of a seal 10 according to this disclosure. A seal 10 is installed within a channel 46 between a first component 48 and a second component 50. In this embodiment, the first component 48 includes a chamber 130 formed therein and in fluid communication with the recess or channel 46 through a port 132. The chamber 130 may provide a sealed space configured to contain a fluid (e.g., nitrogen or other gas) under pressure. It will be appreciated by those skilled in the art that the chamber 130 may be formed in the first component 48 by any suitable means as known in the art (e.g., a machined cavity having a sealing end cap, by casting, by 3D printing, etc.). In some embodiments, the chamber 130 may be pressurized by injecting a suitable fluid, e.g., gas, through a nozzle 134 on an end cap 136 (e.g., a threaded cap or plug), which end cap 136 closes the chamber 130 at one end as shown in FIG. 8. In some embodiments, a pressurized gas cartridge 138 may be disposed in the chamber 130 and used to fill the chamber 130 with any suitable gas as known in the art. In some embodiments, the chamber 130 may be pressurized with a suitable liquid (e.g., oil or grease). In some embodiments, a setting or curing filler compound (e.g., epoxy or thermoplastic) may be used to pressurize the chamber 130 and thereby energize the seal 10.

When the seal 10 is installed in the channel 46, the wings 22, 24 on the seal 10 extend out laterally to simultaneously contact both sides of the channel 46. Once fluid pressure (shown by arrow 140) is applied to the space in the channel 46 underneath the seal 10 (e.g., through port 132), the seal 10 moves upward as a result of the fact that the channel 46 side walls are closed to fluid flow by the wings 22, 24 on the seal body 12. The higher the fluid pressure 140, the greater the sealing forces applied to the wings 22, 24. As such, the wings 22, 24 provide that the seal 10 is pressure activated and the seal 10 is thereby energized.

As shown in FIG. 8, the raised portion(s) 30 at the top of the seal 10 also provide(s) a seal against the face A by reason of engagement with the second component 50. Sealing by face A may also be activated by the pressurized fluid 140 acting on the area beneath the seal 10 in the recess or channel 46. In some embodiments, such as the embodiment shown in FIG. 3, the inclusion of an O-ring 54 between the wings 22, 24 may provide seal activation before fluid pressure 140 is applied, thereby providing a low-pressure sealing capability as well as higher pressure capability after fluid pressure activation of the seal 10.

Figure 9:
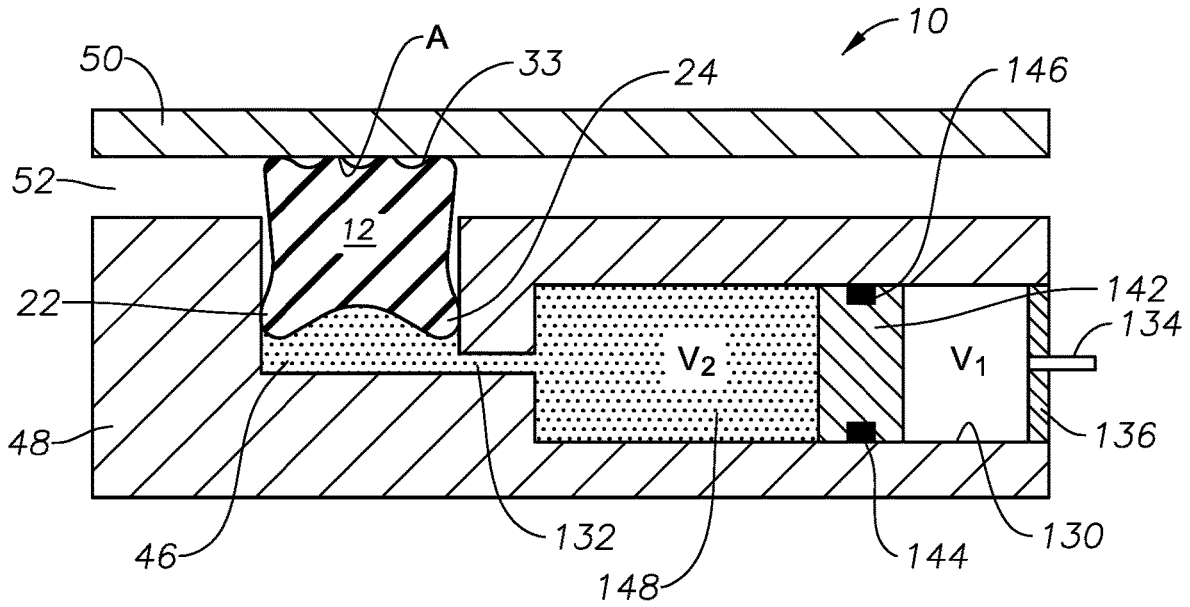
FIG. 9 shows another embodiment of a seal according to this disclosure.

FIG. 9 shows another embodiment of a seal 10 according to this disclosure. The seal 10 is shown installed within a channel 46 to provide sealing between a first component 48 and a and second component 50. As with the embodiment shown in FIG. 8, the first component 48 includes a chamber 130 in fluid communication with the channel 46 through a port 132. In the present embodiment, the chamber 130 may include a piston 142 configured to slide within the chamber 130, separating the chamber into two volumes V1, V2. In the present example embodiment, the chamber 130 may be cylindrically shaped. Within a cylindrically shaped chamber 130, the piston 142 may comprise a disc or flat cylinder having seal 144 such as an O-ring disposed in a groove 146 formed on the circumference of the piston 142. The piston 142 may be formed of any suitable material. In some embodiments, the chamber 130 may be sealed using metal-to-metal seals as the seal 144 on the piston 142. Volume V1 of the chamber 130 may be pressurized by injecting a suitable fluid, e.g., gas, through the nozzle 134 on the end cap 136 (sealing the chamber at one end as explained with reference to FIG. 8. Fluid pressure may also be provided, e.g., by a pressurized gas cartridge (138 in FIG. 8), or any other suitable means as described herein. On the other side of the piston 142, volume V2 of the chamber 130 may contain a semi-solid compound 148 (e.g., a very high viscosity or thixotropic fluid such as a suitable grease or other semi-solid compound as known in the art). The volume V2 may be pre-loaded with the semi-solid compound 148 during assembly of the structure. Use of the semi-solid compound 148 in volume V2 may provide an advantage in some implementations where higher pressures need to be applied to activate the seal 10 since the semi-solid compound 148 is less prone to leakage than, for example, liquid or gas.

Although the seals 10 in FIGS. 8 and 9 are shown as energized (i.e., with the pressurized gas/compound acting on the space beneath the seal), the seals may also be implemented in configurations where the seals are installed unenergized. A seal 10 may be placed to initially sit in the channel 46 without application of the pressurized gas 140 or compound 148. In such applications, the seal 10 provides sealing against both sides of the channel 46 through the wings 22, 24, without the face A being in contact with the second component 50. Then, at a subsequent time, fluid under pressure (e.g., gas 140 or compound 148) can be released to act on the space in the channel 46 beneath the seal 10. Since the channel 46 sides are closed, the seal 10 will then move upwards to engage the face A with the second component 50, establishing a seal on face A. It will be appreciated that the pressures placed on the face A and sides (e.g., wings 22, 24) of the seal 10 could be different depending on the implementation. Control of these pressures allows seal by the face A to be maintained as desired. It will also be appreciated by those skilled in the art that some embodiments may be configured with conventional electronics and software to automatically and autonomously pressurize the chamber 130 to energize the seals 10, e.g., by introducing pressure to the chamber 130 by release of pressurized gas through the nozzle 134, to establish a face seal at face A at a desired time or under certain conditions.

Figure 10:
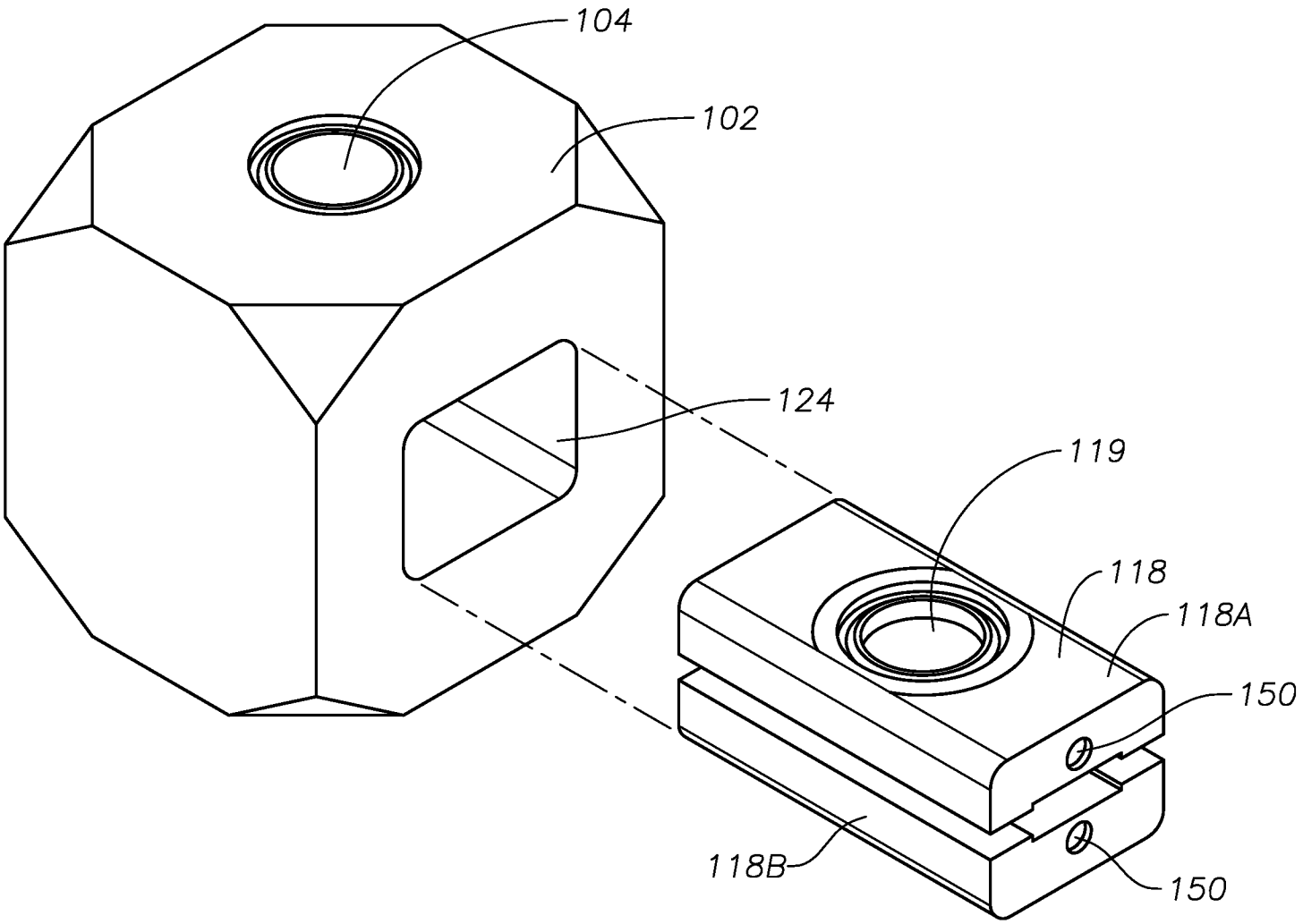
FIG. 10 shows a schematic of another main body embodiment of a kinetic BOP.

FIG. 10 shows a schematic of another embodiment of a main body 102 of a kinetic BOP 100 (similar to the embodiments of FIGS. 5-7) with an expanded view of an insert 118 embodiment according to this disclosure. For clarity of illustration, the main body 102 is shown without a cover (108 in FIG. 7) or pressure chamber (110 in FIG. 5). The insert 118 may be configured as a modular assembly comprising a first insert segment 118A and a second insert segment 118B. Each insert segment 118A, 118B is configured with any embodiment of a pressurized seal 10 (see FIGS. 8-9) and may have an opening or port 150 at each longitudinal end, leading to the chamber 130 as shown in and described with reference to FIGS. 8-9. The ports 150 may be sealed using end caps (e.g., as shown at 136 in FIGS. 8-9).

Figure 11:
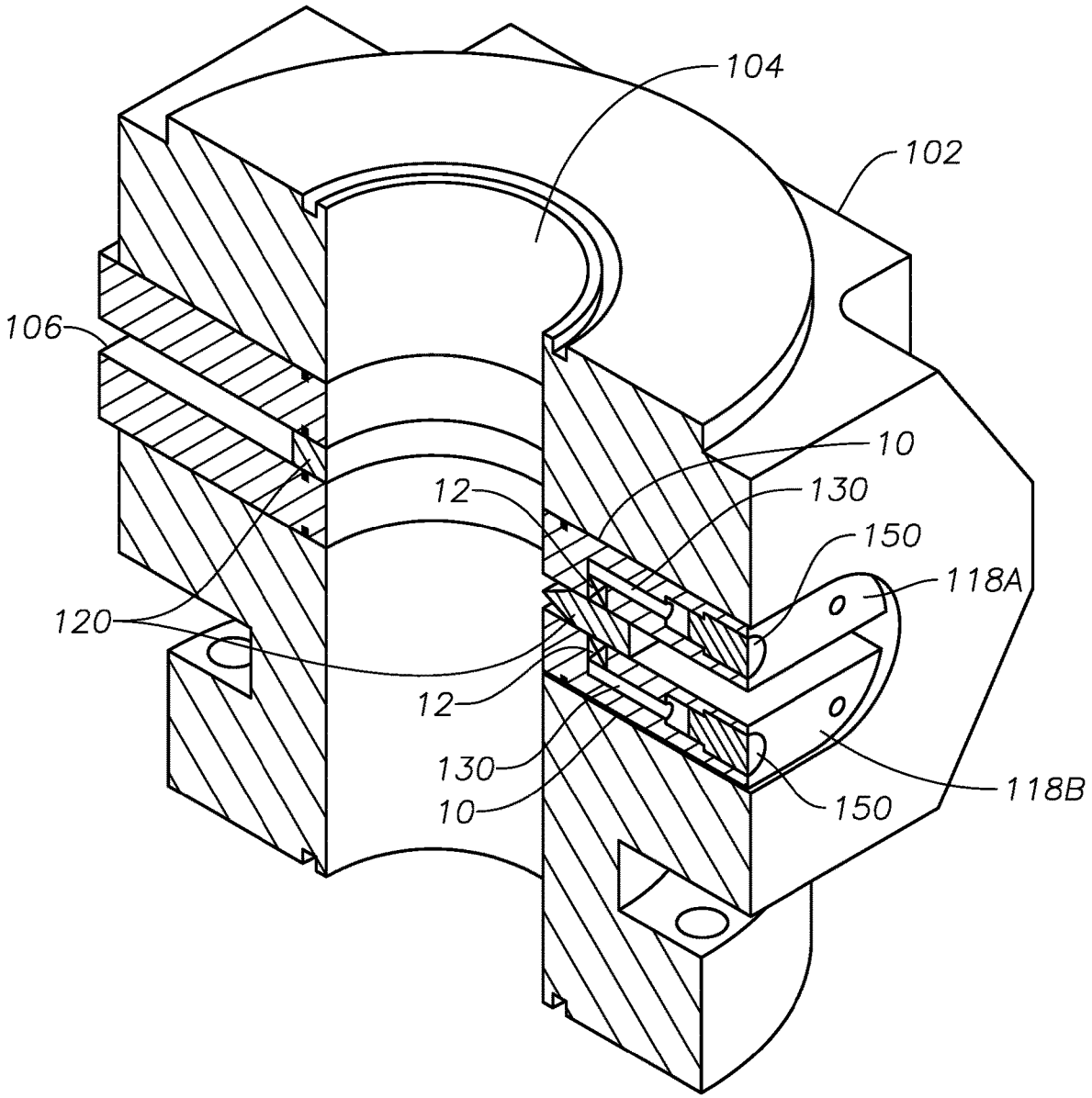
FIG. 11 shows an elevational partial cut-away view of a main body embodiment of a kinetic BOP with an insert mounted within the main body.

FIG. 11 shows an elevational partial cut-away view of an embodiment of the main body 102 of a kinetic BOP 100 with an insert 118 (formed from segments 118A, 118B) mounted within the main body 102. Each insert segment 118A, 118B includes an embodiment of a pressurized seal 10 such as shown in and explained with reference to FIGS. 8-9. The seals 10 are shown disposed in the insert segments 118A, 118B such that the face of each seal body 12 respectively engages the upper and lower surface of the ring cutter 120. For clarity of illustration, a partial cutaway of the insert 118 is shown. It will be appreciated that the respective seal bodies 12 in the insert segments 118A, 118B are configured in a closed loop pattern (See seal 10 in FIG. 1A) to provide sealing around the circumference of the through b ore 104. As previously discussed, some embodiments may be configured with conventional electronics and software to automatically and autonomously activate and energize the seals 10 to establish both lateral and face sealing at a desired time or under certain conditions.

Figure 12A:
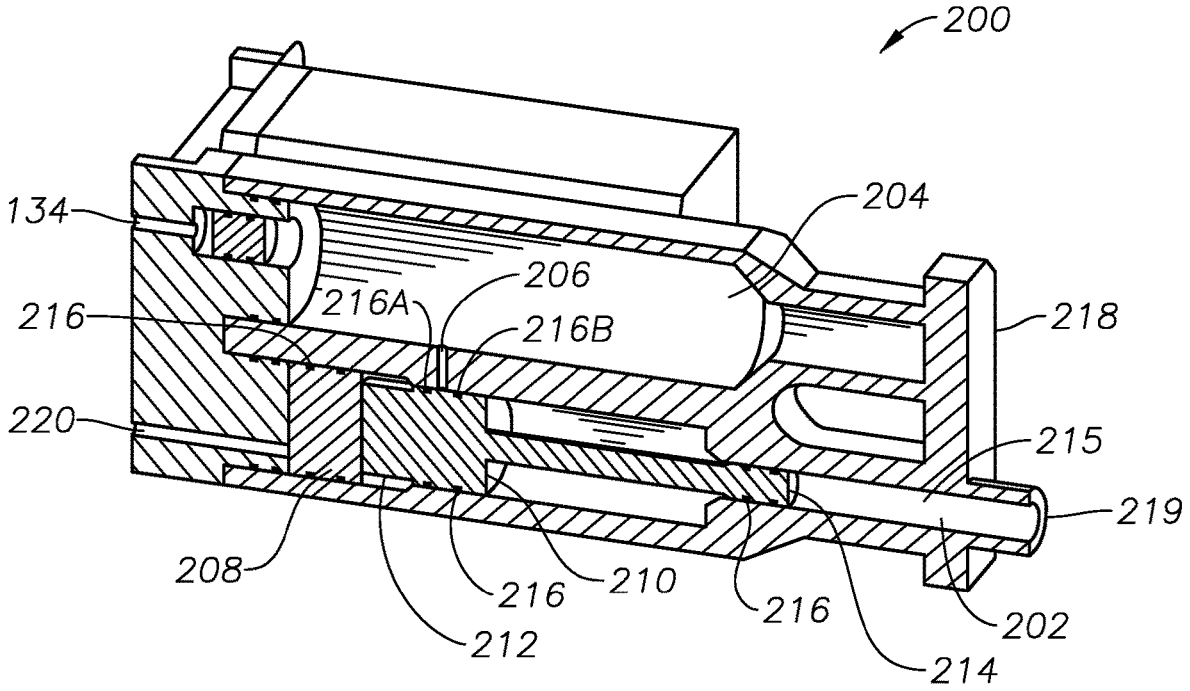
FIG. 12A shows a partial cut-away view of an example embodiment of a pressure vessel according to this disclosure.

FIG. 12A shows a partial cutaway view of a pressure intensifier vessel 200 embodiment according to this disclosure. This vessel 200 has two internal cylindrical chambers. A first chamber 202 is designed to contain a fluid. A second chamber 204 is designed to contain a gas under pressure (e.g., nitrogen). The chamber 204 may be supplied and pressurized with the gas as disclosed herein and known in the art. The two chambers 202, 204 are independent of one another. However, the vessel 200 is configured with an interconnecting port 206 providing a passage between the two chambers 202, 204.

The first chamber 202 houses a first piston 208 and second piston 210. The two pistons 208, 210 are independent of one another. The second piston 210 is configured with a large diameter disc section 212 at one end and a smaller diameter stem section terminating with a small diameter disc section 214 at the other end. The small diameter disc section 214 slides within a narrowed section 215 of the first chamber 202. Both pistons 208, 210 are fitted with seals 216 (e.g., O-rings) to provide sealing integrity within the first chamber 202.

The vessel in FIG. 12A is shown in a resting mode. In this mode, the second chamber 204 contains the gas under pressure. The first 208 and second 210 pistons are positioned at one end of the first chamber 202 such that the central region of the large diameter disc section 212 of the second piston 210 is positioned to block the orifice of the interconnecting port 206. The large diameter disc section 212 is fitted with a pair of seals 216A, 216B (e.g., O-rings) to provide sealing integrity for the port 206 orifice aligned between the seals. The narrowed section 215 of the first chamber 202 is filled with a fluid (e.g., a very high viscosity or thixotropic fluid such as a suitable grease or other semi-solid compound as known in the art). The first chamber 202 may be pre-filled or supplied with the fluid after assembly via injection means as disclosed herein and known in the art. The narrowed section 215 of the first chamber 202 extends out from a flange 218 on the vessel 200, forming a port 219.

Figure 12B:
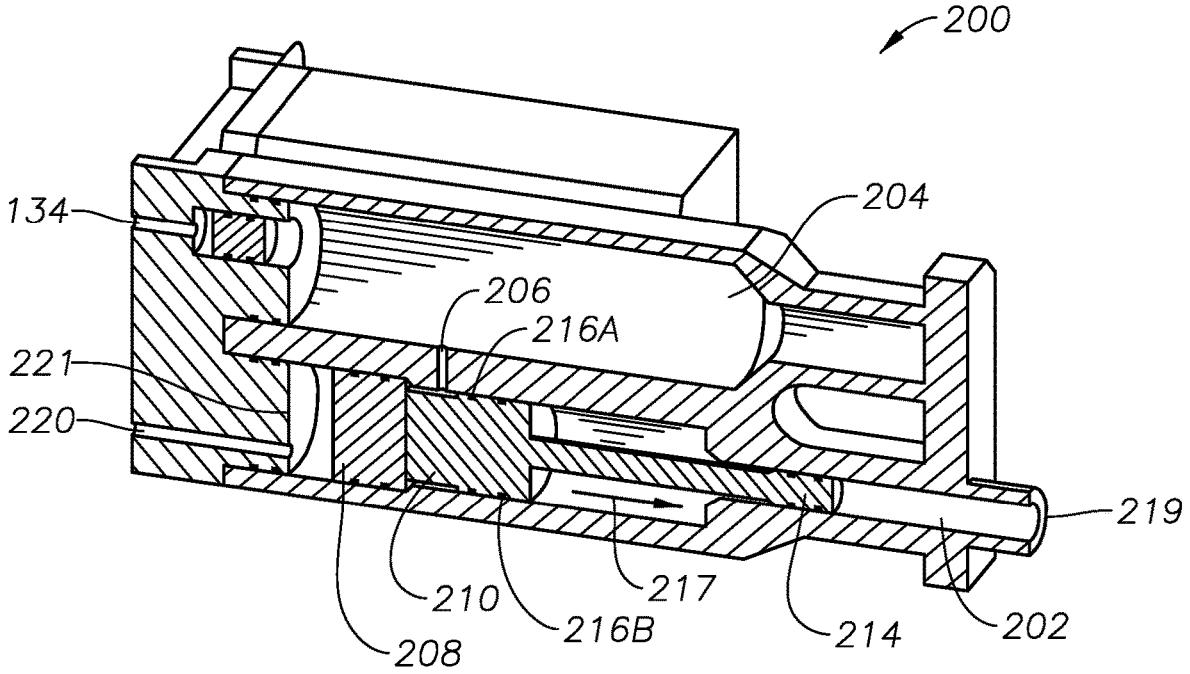
FIG. 12B shows the pressure vessel of FIG. 12A with the vessel in a transition stage.

FIG. 12B shows the vessel 200 in a triggering mode. The vessel 200 is configured with a gas feed port 220 that links the first chamber 202 to a high-pressure gas source. For example, when implemented with a BOP 100 (FIGS. 5, 7) the vessel 200 is disposed on the BOP 100 such that the gas feed port 220 is coupled to the high-pressure gas passageway (e.g., 106 in FIG. 7). Upon activation of the BOP 100 pyrotechnic charge 114 (as described herein), the rapid expansion of hot gas produces a high-pressure surge through the gas feed port 220, which leads into the first chamber 202 to displace the first piston 208 (to the right in FIG. 12B). Upon displacement, the first piston 208 acts as a bump piston to push the second piston 210 (to the right in FIG. 12B) such that the port 206 orifice is no longer obstructed by the seals 216A, 216B on disc section 212. With the port 206 orifice unobstructed, the pressurized gas from the second chamber 204 floods into the first chamber 202 behind the large diameter disc section 212 to actuate and propel the second piston 210 toward the opposite end of the first chamber 202 (arrow 217). It will be appreciated by those skilled in the art that embodiments may be implemented with the gas feed port 220 coupled to different high-pressure gas sources to operate as disclosed herein.

As the pressurized gas from the second chamber 204 floods into the first chamber 202 it propels the second piston 210, which in turn pushes the fluid toward the port 219 end of the chamber 202. Since the surface area of the back of the second piston 210 is much larger than the front stem end, this allows for a relatively low-pressure gas (in second chamber 204) to create a high-pressure fluid head at the port 219. In essence, the second piston 210 is formed to act as a plunger to push out the fluid in the second chamber 204 through the port 219 under high pressure.

Figure 12C:
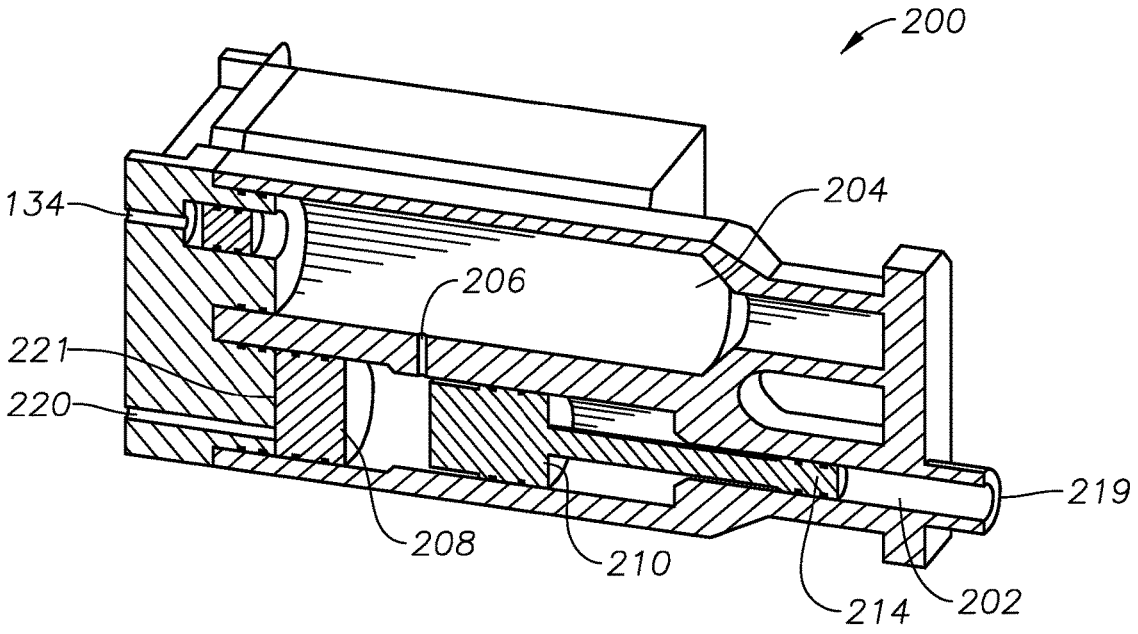
FIG. 12C shows the pressure vessel of FIG. 12A with the vessel in a pressurization stage.

FIG. 12C shows the vessel 200 in an activated mode. In this mode, the incoming gas through the feed port 220 has started to cool as the BOP 100 firing chamber gas expansion is completed, or the pressurized gas feed from another source has terminated. As shown in FIG. 12C, the first piston 210 resets 221 to abut the first chamber 202 wall as gas pressure from the feed port 220 drops. However, the first chamber 202 remains pressurized by the gas that flooded in from the second chamber 204 via the interconnecting port 206 orifice.

Figure 13:
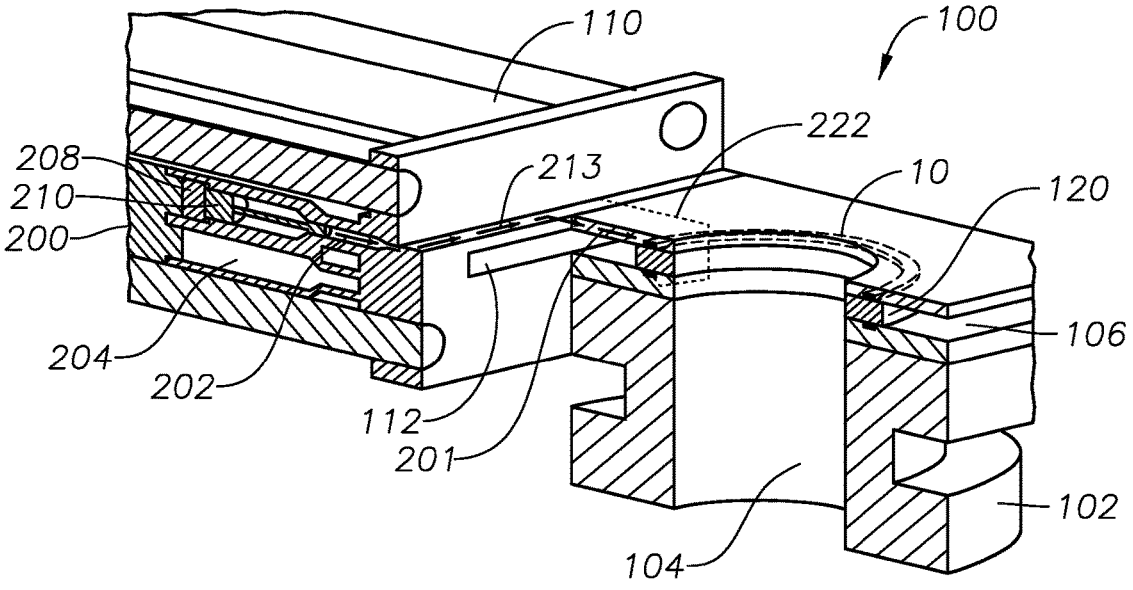
FIG. 13 shows a partial cut-away view of a pressure vessel embodiment adjacent a BOP body according to this disclosure.

FIG. 13 shows a partial cutaway view of a pressure intensifier vessel 200 mounted on a BOP 100. In some embodiments, the vessel(s) 200 may be formed in or mounted onto the pressure chamber 110 (see FIG. 5). As shown in FIG. 13, the main body 102 of the BOP 100 is configured with a port opening leading to a channel 201 that leads to the heel or bottom side of the seal 10 disposed in the main body 102 with its central opening coincident with the through bore 104. Returning to FIG. 12C, the port 219 extending from the end of the pressure vessel 200 is aligned and coupled with the port in the main body 102 to channel the flow of pressurized fluid from the first chamber 202 to energize the seal 10 (similar in operation to the embodiment of FIG. 9). With BOP 100 embodiments configured with seals 10 disposed on an insert 118, the port 219 extending from the end of the pressure vessel 200 can be coupled to the opening 150 of the insert segment(s) 118A, 118B (see FIGS. 10 & 11).

Embodiments may be implemented with one intensifier pressure vessel 200 linked to more than one seal 10 to provide the intensified fluid pressure to energize the seals 10 as described herein. Other embodiments may be implemented with each seal 10 linked to its own independent pressure vessel 200. FIG. 13 shows an embodiment with one pressure vessel 200 exposed on one side of the BOP 100 pressure chamber 110. The vessel 200 port 219 feeds into the channel 201 in the main body 102 that leads to the bottom side of the upper seal 10 (arrows 213). Although not shown in FIG. 13 for clarity of illustration, a second intensifier pressure vessel 200 is disposed on the other side of the pressure chamber 110. The pressurized fluid port 219 of the second vessel 200 is similarly coupled to a channel in the main body 102 that leads to the bottom side of the lower seal 10 (dashed line 222). In this manner, the two seals 10 are provided maximum pressure energization via the independent pressure vessels 200.

FIG. 13 shows the main body 102 with a ring cutter 120 element in position coincident with the through bore 104. As previously described, when the BOP 100 charge 114 is activated to propel the gate 112 across the through bore 104 (see FIG. 7), the pressure vessel(s) 200 is/are actuated to release the pressurized fluid in the first chamber(s) 202, thereby activating and energizing the respective seal(s) 10 in the main body 102 to provide secure fluid integrity between the transverse passage 106 and the through bore 104.

Figure 14A:
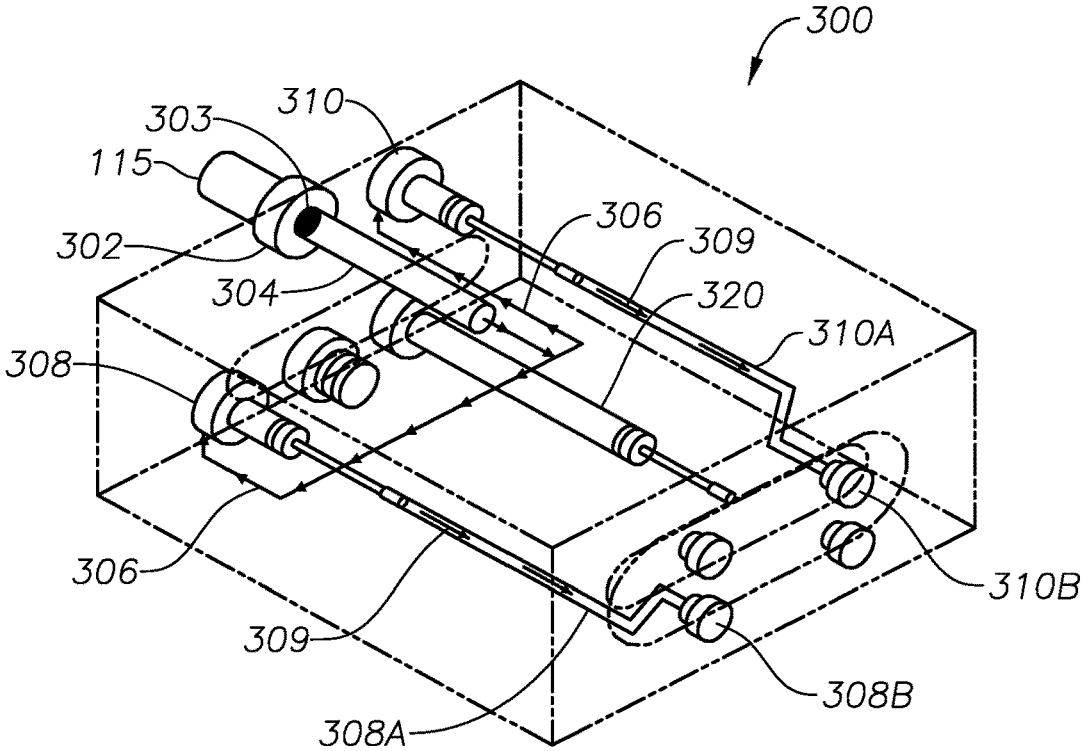
FIG. 14A shows a transparency schematic of an example embodiment of a seal pressurization module according to this disclosure.

FIG. 14A shows a transparency schematic of a seal pressurization module 300 embodiment of this disclosure. The module 300 is implemented with internal cylindrical ports housing pistons configured for displacement and pressurization similar to the piston embodiments of FIGS. 12A-12C. However, unlike the pressure vessel 200 of FIG. 12A, the module 300 is implemented with a gas generator 302. The generator 302 is configured with a small charge 303 wired for electrical ignition (similar to the charge 114 used to actuate the piston-gate in BOP 100). The module 300 includes an internal chamber 304 to receive the expanding gas when the charge 303 is ignited. The chamber 304 is ported to channel (arrows 306) the high pressure gas to the back surface of first 308 and second 310 pistons mounted within their own respective chambers 308A, 310A. The pistons 308, 310 are configured in the same plunger-type design as the second pistons 210 of the pressure vessel 200 of FIG. 12. The chambers 308A, 310A are filled with a fluid (e.g., a very high viscosity or thixotropic fluid such as a suitable grease or other semi-solid compound as known in the art). When the gas generator 302 is ignited, the expanding gas displaces the pistons 308, 310 to push and expel (arrows 309) the fluid in the chambers 308A, 310A via respective ports 308B, 310B. The pressurized fluid is then channeled to seals 10 in a BOP 100 (further described below).

Figure 14B:
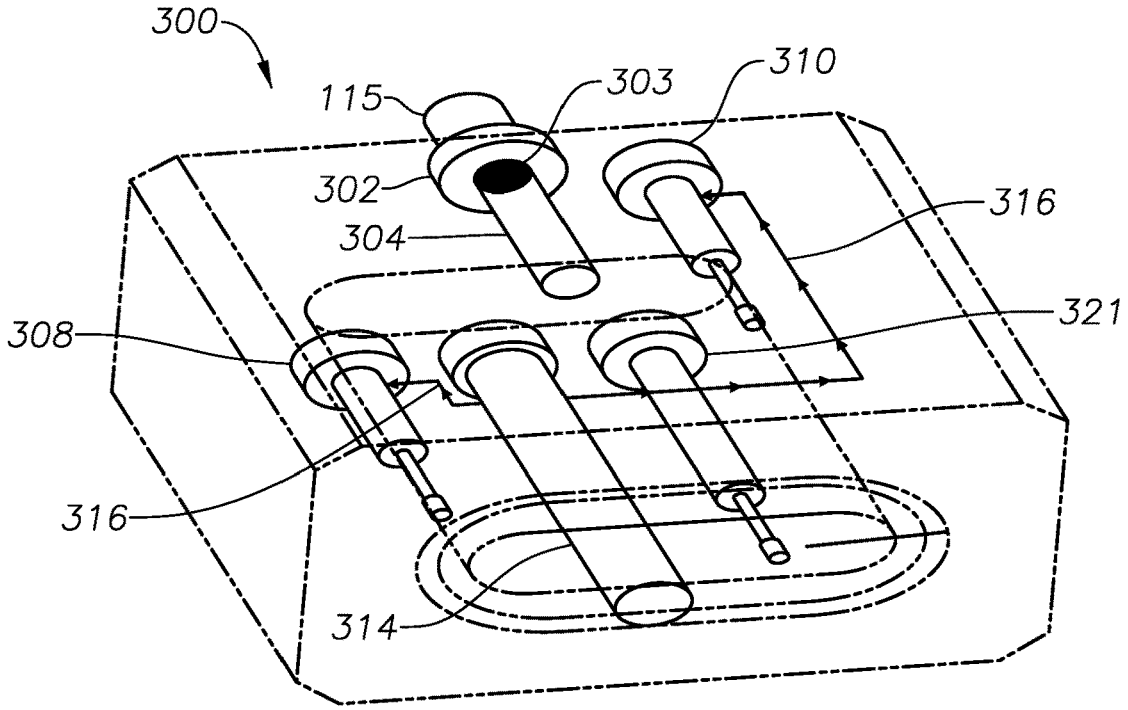
FIG. 14B shows the seal pressurization module of FIG. 14A in another mode.

FIG. 14B shows another transparency schematic of the seal pressurization module 300 of FIG. 14A. In addition to the gas generator 302, the module 300 is implemented with an internal chamber 314 configured to hold a gas (e.g., nitrogen) under pressure. The chamber 314 provides a second gas pressurization source. In operation, the gas generator 302 is preferably fired first to pressurize the fluid in the chambers 308A, 310A via the pistons 308, 310, as shown in FIG. 14A. Then, after a time delay wherein the gas generator 302 has cooled, a port in the gas chamber 314 is opened to channel (arrows 316) the pressurized gas to the back surface of the first 308 and second 310 pistons, which further pressurizes the fluid in the chambers 308A, 310A for long term seal 10 energization (further described below).

FIGS. 14A and 14B show a module embodiment implemented with a second internal chamber 320 configured to hold a gas (e.g., nitrogen) under pressure. However, unlike chamber 314 which only contains a pressurized gas, the second chamber 320 is implemented with a plunger-type piston 321 and filled with a fluid (similar to the piston embodiments of FIGS. 12A-12C). The second chamber 320 provides a static chamber for initial pressurization to energize the seals 10 (further described below).

Figure 15:
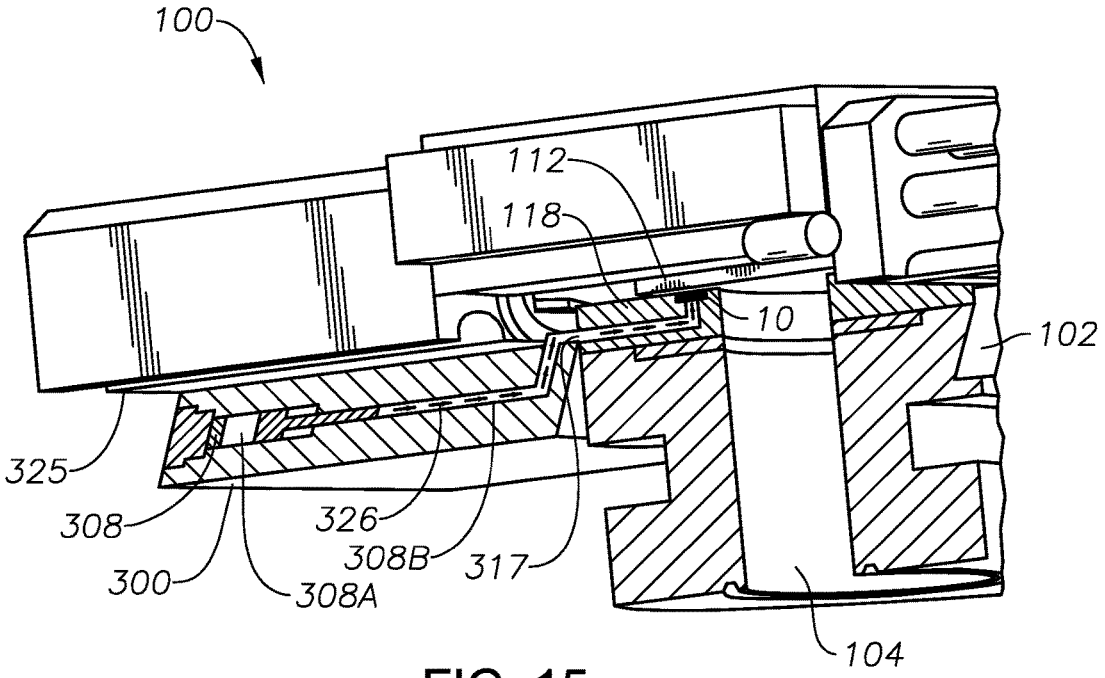
FIG. 15 shows a partial view of an example embodiment of a BOP with a pressurization bonnet according to this disclosure.

FIG. 15 shows a partial view of a BOP 100 embodiment implemented with a pressurization module 300 of FIG. 14A. In this embodiment, the module is wholly internally implemented in the bonnet 325 forming one end section of the BOP 100. FIG. 15 shows a partial cutaway view of the first piston 308 in chamber 308A (see FIGS. 14A-B). The bonnet 325 is coupled to the main body 102 of the BOP 100 such that the port 308B exiting chamber 308A links with a port 317 in the main body 102 leading to the seal 10. The embodiment of FIG. 15 is shown implemented with a second or lower seal 10 disposed on an insert 118 as described herein (see FIGS. 10, 11). In this embodiment, the chamber 308A port 308B is linked to the port (e.g., 150 in FIG. 10) on the insert 118 such that the pressurized fluid is channeled (arrow 326) from the chamber 308A to energize the second seal 10. Although not shown in FIG. 15 for clarity of illustration, it will be understood that the internal module 300 is implemented with a second piston 310 in a second chamber 310A and similarly ported to channel the pressurized fluid from chamber 310A to energize the first or upper seal 10 (see FIG. 16). The internal module 300 may also be implemented with the static pressurized gas chamber 320. As shown in FIG. 15, the BOP 100 is in a state wherein the gate 112 element is in the actuated or sealing position across the through bore 104, as described herein. As previously described, in this state the gas generator 302 and pistons 308, 310 have been actuated to fully energize the first and second seals 10 into sealing engagement with the respective gate 112 surfaces.

Figure 16:
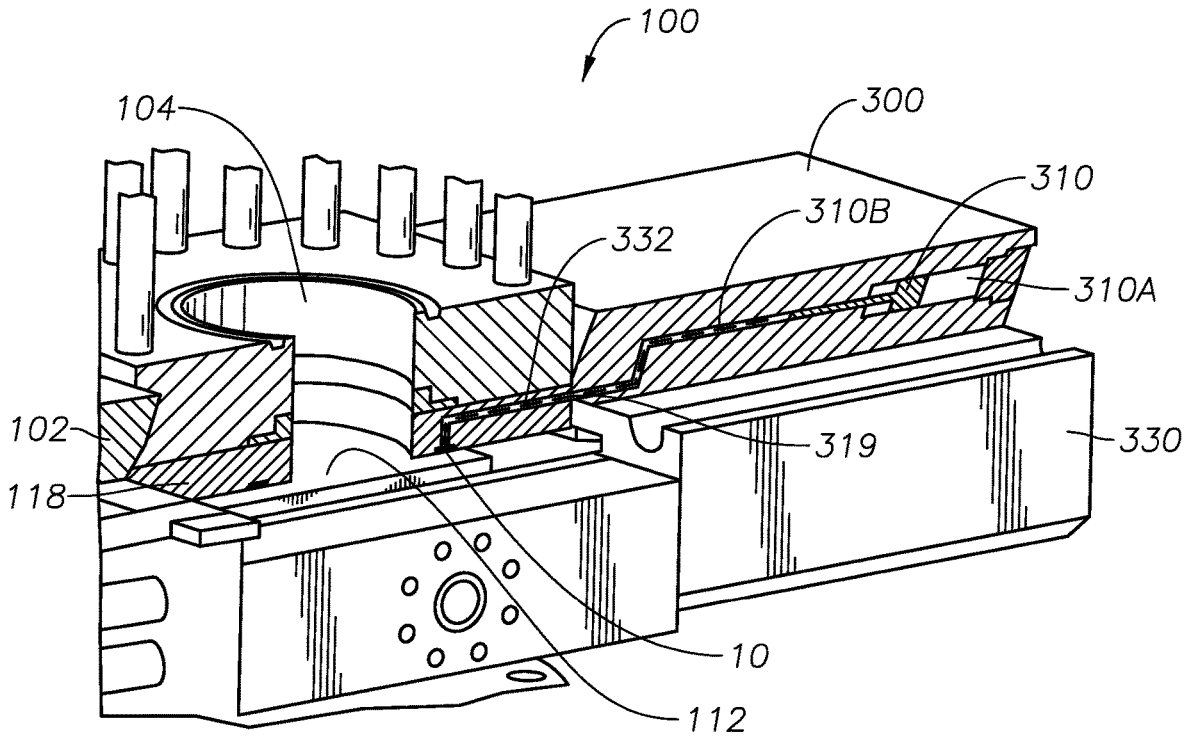
FIG. 16 shows another partial view the BOP of FIG. 15.

FIG. 16 shows a partial view of the other end of the BOP 100 embodiment of FIG. 15. The bonnet 330 at this end of the BOP 100 is also implemented with an internal pressurization module 300. Similar to the operation of the module 300 in the opposing bonnet 325, the second piston 310 in chamber 310A (see FIG. 14A-B) of bonnet 330 is configured to expel the pressurized fluid from the port 310B linked to a port 319 in the main body 102 leading to the first or upper seal 10. The second seal 10 is also disposed on an insert 118 as described herein (see FIGS. 10, 11). Upon actuation of the gas generator 302 and piston 310 in the module 300 in bonnet 330, the pressurized fluid is channeled (arrow 332) from the chamber 310A to energize the first or upper seal 10. Although not shown in FIG. 16 for clarity of illustration, it will be understood that the internal module 300 is implemented with a first piston 308 in a first chamber 308A and similarly ported to channel the pressurized fluid from chamber 308A to energize the second or lower seal 10 (See FIG. 15). The module 300 may also be implemented with a static pressurized gas chamber 320. As disclosed herein, both the first and second seals 10 are energized by each internal module 300 on the BOP 100.

As previously described, seal 10 embodiments of this disclosure may be implemented for use with elements with the seals 10 having an initial pressurization or with the seals in an unenergized state for later energization depending on the implementation. For example, BOPs 100 implemented with pressurization modules 300 equipped with static chambers 320 may be actuated to provide an initial seal 10 seating pressurization. The static chambers 320 may be actuated to initially energize and seat the seals 10 against a ring cutter 120 element disposed between the seals 10 (see FIG. 13) prior to displacement of the gate 112 element across the through bore 104.

Advantages of the disclosed seal 10 and pressurization unit embodiments include improved sealing integrity compared to conventional seal systems. A relatively low-pressure gas is applied to intensify a fluid to energize a seal 10 with a much higher pressure than the pressure of a process fluid. For example, the intensified pressures produced by the disclosed embodiments result in seal 10 energization ranging approximately between 17,000-30,000 psi (117211-206843 kPa). The gas chambers, fluid chambers, and pistons implemented with the BOPs 100 are also closed systems, not requiring external supply lines or components.

In light of the principles and example embodiments described and illustrated herein, it will be recognized that the example embodiments can be modified in arrangement and detail without departing from such principles. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

The invention claimed is:

1. A blowout preventer (BOP), comprising:
- a main body having a through bore, the main body defining a passage transverse to the through bore;
- at least one seal configured for positioning with an opening on the at least one seal in alignment with the through bore;
- the at least one seal configured for disposal in the main body to engage an element disposed in the transverse passage;
- a first chamber configured to contain a fluid for communication with at least one port configured to convey the fluid to the at least one seal;
- a second chamber configured to contain a gas under pressure;
- wherein the first and second chambers are linked together to permit expansion of the pressurized gas from the second chamber into the first chamber to pressurize the fluid in the first chamber; and
- wherein the at least one seal is configured to receive the fluid under pressure to energize the seal to restrict fluid flow between the through bore and the transverse passage when the element is disposed proximate the through bore.

2. The BOP of claim 1 wherein the element comprises a gate or a ring cutter.

3. The BOP of claim 1 wherein the fluid comprises a grease compound.

4. The BOP of claim 1 further comprising a first piston disposed within the first chamber to displace the fluid in the first chamber for conveyance to the at least one seal.

5. The BOP of claim 4 further comprising a second piston disposed within the first chamber to actuate the first piston.

6. The BOP of claim 1 further comprising a plurality of chambers configured to contain the fluid for conveyance to the at least one seal.

7. The BOP of claim 6 wherein each chamber of the plurality of chambers comprises a piston to displace the fluid in the chamber.

8. The BOP of claim 6 further comprising a gas generator configured to pressurize the fluid in at least one of the chambers configured to contain the fluid.

9. The BOP of claim 8 further comprising a gas chamber configured to contain a gas under pressure to pressurize the fluid in at least one of the chambers configured to contain the fluid.

10. The BOP of claim 1 further comprising:
- a plurality of seals, each seal of the plurality of seals configured for positioning with an opening on the seal in alignment with the through bore;

each seal of the plurality of seals configured for disposal in the main body to engage an element disposed in the transverse passage;

wherein each seal of the plurality of seals is configured to receive a fluid under pressure to energize the seal to restrict fluid flow between the through bore and the transverse passage when the element is disposed proximate the through bore.

11. The BOP of claim 10 wherein each seal of the plurality of seals is configured to receive a fluid under pressure to energize the seal to restrict fluid flow between the through bore and the transverse passage when the element is disposed proximate the through bore in between two of the seals of the plurality of seals.

12. The BOP of claim 10 wherein the plurality of seals are disposed on an insert configured for disposal in the main body.

13. A method for operating a blowout preventer (BOP) comprising a main body having a through bore and a passage transverse to the through bore, at least one seal configured for positioning with an opening on the at least one seal in alignment with the through bore, the at least one seal configured for disposal in the main body to engage an element disposed in the transverse passage, a first chamber containing a fluid, and a second chamber containing a gas under pressure, wherein the first and second chambers are linked together, the method comprising:

releasing the pressurized gas from the second chamber into the first chamber to pressurize the fluid in the first chamber; and applying the fluid under pressure to the at least one seal via a port to energize the at least one seal to restrict fluid flow between the through bore and the passage when the element is disposed proximate the through bore.

14. The method of claim 13 wherein the element comprises a gate or a ring cutter.

15. The method of claim 13 wherein the fluid comprises a grease compound.

16. The method of claim 13 further comprising using a first piston disposed within the first chamber to displace the fluid in the first chamber for conveyance to the at least one seal.

17. The method of claim 16 further comprising actuating the first piston with a second piston disposed within the first chamber.

18. The method of claim 13 wherein applying the fluid under pressure comprises actuating a gas generator disposed on the BOP.

19. The method of claim 13 wherein applying the fluid under pressure comprises sequentially actuating a gas generator disposed on the BOP and releasing a pressurized gas from a chamber disposed on the BOP.

20. The method of claim 13 wherein the BOP comprises a plurality of seals, each seal of the plurality of seals configured for positioning with an opening on the seal in alignment with the through bore, each seal of the plurality of seals configured for disposal in the main body to engage an element disposed in the transverse passage, and applying the fluid under pressure to each seal of the plurality of seals to energize the seal to restrict fluid flow between the through bore and the passage when the element is disposed proximate the through bore.

21. A method for operating a blowout preventer comprising a main body having a through bore and a passage transverse to the through bore, at least one seal configured for positioning with an opening on the at least one seal in alignment with the through bore, the at least one seal configured for disposal in the main body to engage an element disposed in the transverse passage, the method comprising:

energizing the at least one seal to restrict fluid flow between the through bore and the passage when the element is disposed proximate the through bore by sequentially applying a fluid under pressure to the at least one seal.

22. A blowout preventer comprising:

a main body having a through bore;

the main body having a passage transverse to the through bore;

at least one seal configured for positioning with an opening on the at least one seal in alignment with the through bore;

the at least one seal configured for disposal in the main body to engage an element disposed in the transverse passage; and wherein the at least one seal is configured to sequentially receive a fluid under pressure to energize the at least one seal to restrict fluid flow between the through bore and the transverse passage when the element is disposed proximate the through bore.

* * * * *